United States Patent [19]

Yokoyama

[11] 4,081,036

[45] Mar. 28, 1978

[54] MOUNTING ARRANGEMENT FOR SUPPORTING BULLDOZER BLADE

[75] Inventor: Masao Yokoyama, Komatsu, Japan

[73] Assignee: Kabushiki Kaisha Komatsu Seisakusho, Tokyo, Japan

[21] Appl. No.: 707,043

[22] Filed: Jul. 20, 1976

[51] Int. Cl.[2] ..... E02F 3/76

[52] U.S. Cl. ..... 172/804

[58] Field of Search ..... 172/803, 804, 805, 806, 172/807, 809; 403/57, 58

[56] References Cited

U.S. PATENT DOCUMENTS

| | | | |
|---|---|---|---|
| 2,027,499 | 1/1936 | Tully | 403/58 X |
| 3,631,930 | 1/1972 | Peterson | 172/804 |
| 3,901,329 | 8/1975 | Eftefield | 172/804 |

FOREIGN PATENT DOCUMENTS

| | | | |
|---|---|---|---|
| 97,101 | 8/1975 | Japan | 172/804 |

*Primary Examiner*—Richard T. Stouffer

*Attorney, Agent, or Firm*—Armstrong, Nikaido, Marmelstein & Kubovcik

[57] ABSTRACT

A mounting arrangement for supporting a bulldozer blade on a vehicle having a C-frame wherein the blade is supported by a centrally located universal joint on the C-frame and a pair of longitudinary arranged hydraulic jacks.

A generally horizontally tilt jack is pivotally connected between the back of the blade and a bracket provided atop the C-frame to stabilize the mounting structure and to tilt the blade.

A rocker arm is pivotally mounted at a central portion thereof to the bracket, one end of the rocker arm being connected to the blade and the other end thereof being connected to the C-frame.

2 Claims, 4 Drawing Figures

MOUNTING ARRANGEMENT FOR SUPPORTING BULLDOZER BLADE

BACKGROUND OF THE INVENTION

This invention relates to bulldozer blade mountings and more particularly to a blade mounting arrangement including a centrally located universal pivot joint and a pair of hydraulic jacks.

In U.S. Pat. No. 3,631,930, there is disclosed a blade mounting arrangement comprising a bulldozer blade having its lower rear surface connected centrally by a universal joint to a C-frame, a pair of angling jacks extending substantially horizontally between respective sides of the blade and the C-frame for adjusting blade angle, and a tilting jack interposed between the blade and the C-frame for stabilizing the blade with respect to a horizontal plane and for controlling blade tilt.

With this prior arrangement, when the tilting jack is actuated to accomplish vertical tilt adjustment of the blade, the pair of angling jacks are urged to move arcuately in opposite, vertical directions, thereby causing the blade to deflect backward. In this instance, the tilting jack coupled between the blade and the C-frame has a tilt bracket serving to limit the rearwardly deflecting movement of the blade. Thus, blade tilt is adjusted with the blade and the tilt bracket slightly yielding to the limiting force. A problem with the prior art mounting arrangement is that the arrangement is subjected to excessive stresses and an amount of tilt adjustment of the blade is restricted.

SUMMARY OF THE INVENTION

According to the present invention there is disclosed a mounting arrangement for supporting bulldozer blade on a vehicle having a mounting frame including an intermediate member extending transversaly at one end of the vehicle, and longitudinally extending side members pivoted to the vehicle, comprising, a universal joint interconnecting a central portion of the blade with the intermediate member of the mounting frame, a pair of hydraulic jacks for angling the blade pivotally interconnected between the mounting frame and respective sides of the blade, means for operating said two hydraulic jacks in opposition to each other for adjusting blade angle, an additional hydraulic jack interconnected between the blade and the mounting frame for tilting the blade about a longitudinal axis of said universal joint.

A rocker arm is provided between the blade and the mounting frame, one end of said rocker arm being connected to a piston rod of said additional hydraulic jack, the other end of said rocker arm being connected to a connecting rod which in turn connects said rocker arm with the blade.

It is, therefore, an object of the present invention to provide an improved bulldozer blade mounting arrangement. It is another object of the present invention to provide a bulldozer blade mounting arrangement wherein backward motion of the blade during the tilting action can be absorbed.

It is a further object of the present invention to provide a bulldozer blade mounting arrangement wherein the blade can be tilted to a greater extent.

Other objects, features and advantages of the present invention can readily be apparent from the following description taken in conjunction with the accompanying drawings.

DETAILED DESCRIPTION OF THE PREFERRED EMBODIMENT

Figure 1:
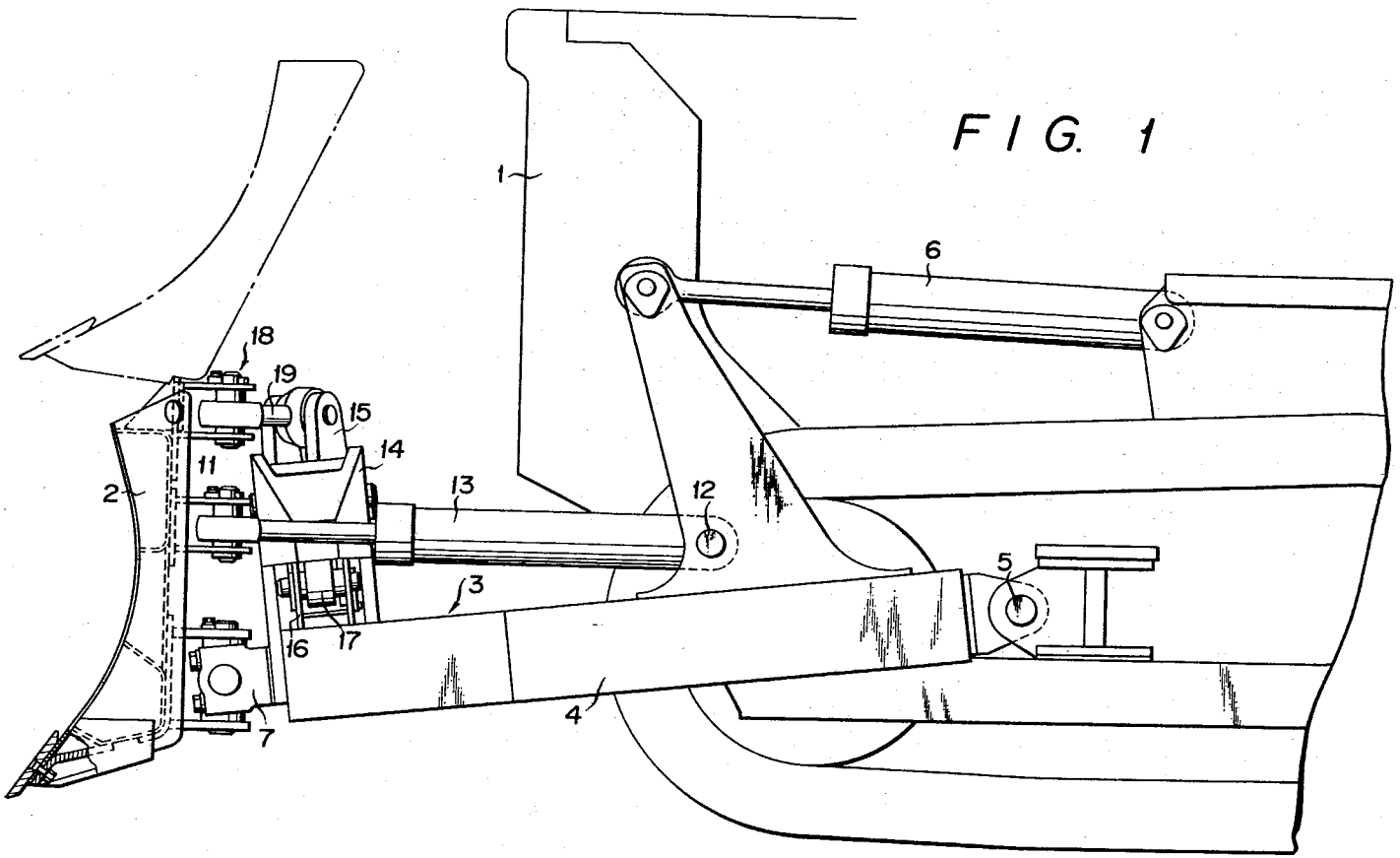
FIG. 1 is a side view in elevation, with parts in section, of a bulldozer blade supported on the forward end of a suitable vehicle.
Figure 2:
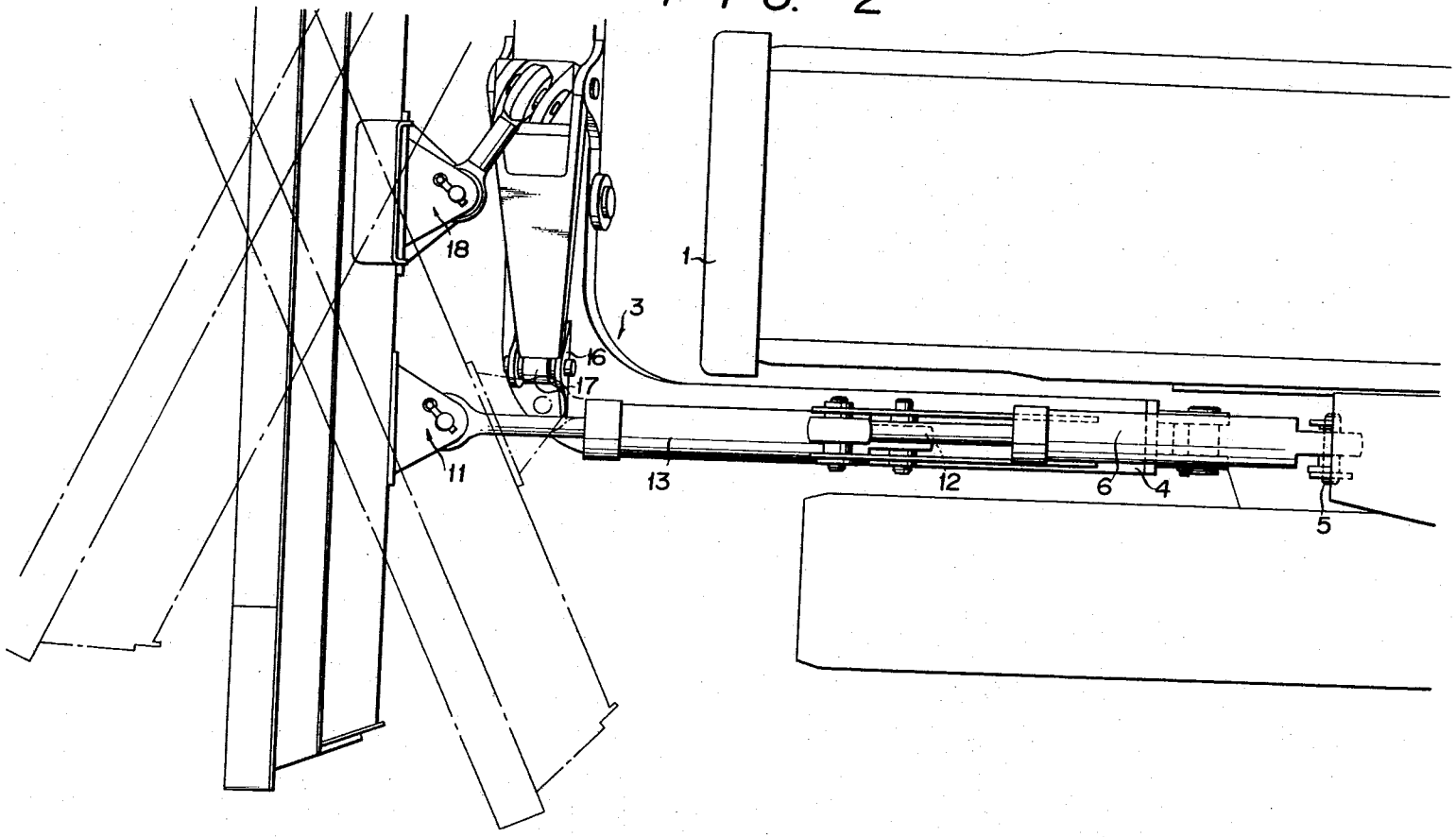
FIG. 2 is a plan view more clearly illustrating portions of the mounting arrangement for the bulldozer blade with angled blade shown by dash and dotted lines.
Figure 4:
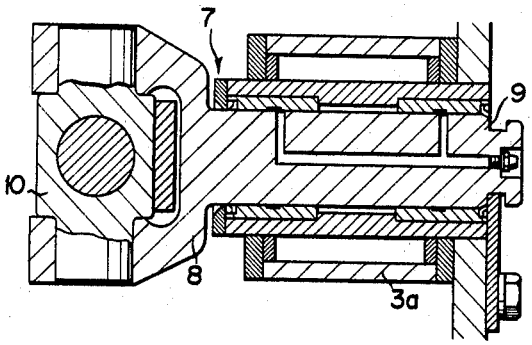
FIG. 4 is a sectional view of a universal joint employed in the present invention.

In FIGS. 1 and 2, a bulldozer blade 2 is mounted through a C-frame 3 on a bulldozer body, partly illustrated at 1. The C-frame 3 has a pair of side arms 4 having rear ends pivotally connected to mount portions 5 of the body 1. Interconnected between the body 1 and the C-frame 3 are lift jacks 6 (only one of them is shown) for raising and lowering the C-frame 3 and the blade 2. The blade 2 is coupled at its rear lower central portion to an intermediate member 3*a* of the C-frame 3 through a universal joint 7. As shown in FIG. 4, the universal ball joint 7 comprises a rotatable shaft or axis 9 having a holder member 8, and cross axes 10 supported by the holder member 8, the rotatable shaft or axis 9 being mounted on the C-frame 3 and a vertical axis of the cross axes 10 being connected to the blade 2.

With this arrangement, the blade 2 is rotatable about the shaft or axis 9 with the longitudinal ends of the blade varying in elevation with respect to a horizontal plane for controlling tilt adjustment of the blade 2. The blade 2 is also rotatable about the vertical axis of the cross axes 10 with the ends of the blade 2 displaced toward and away from the bulldozer body for adjustment of blade angle. Furthermore, the blade 2 is rotatable about a horizontal axis of the cross axes 10 for blade pitch adjustment.

The blade 2 has near its ends a pair of joints 11 (only one is illustrated) each having mounted thereon one end of an angling jack 13 the other end of which is mounted on a joint 12 provided on each of the side arms 4 of the C-frame 3, thereby connecting the blade 2 with the side arms 4.

Figure 3:
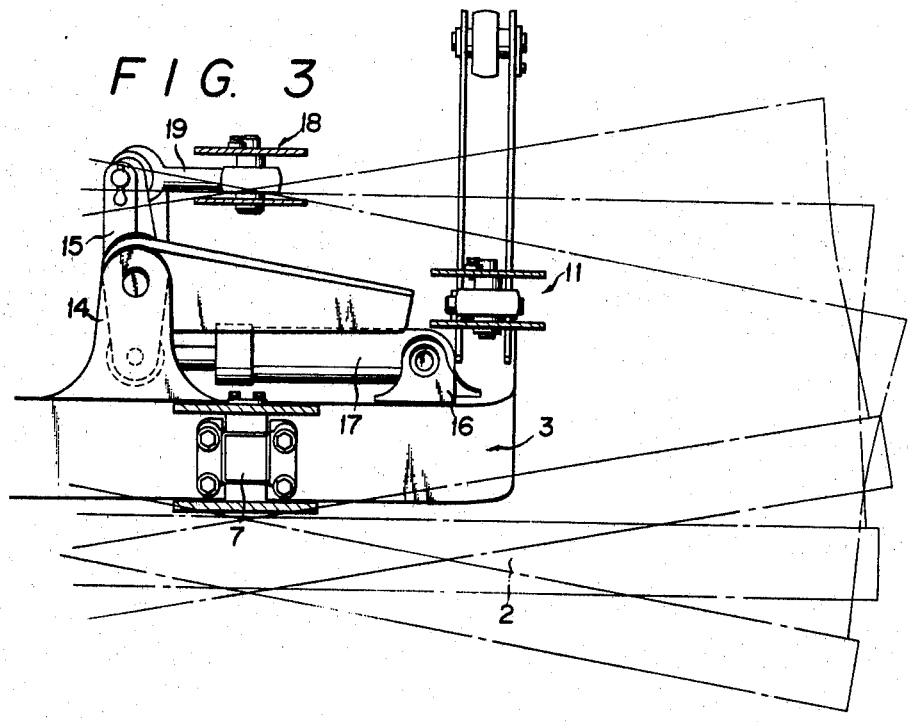
FIG. 3 is an elevational view of the mounting arrangement with blade positions shown by dash and dotted lines.

The intermediate member 3*a* of the C-frame 3 has a bracket 14 fixed thereto and arranged in parallel with the blade 2, there being a rocker arm 15 having a central portion pivoted to the bracket 14 (FIG. 3). The C-frame 3 has on one end of the intermediate member 3*a* a bracket 16 coupled to the bottom end of the rocker arm 15 by a tilting jack 17. The blade 2 has on its rear upper central portion a pivot 18 located vertically coaxially with the vertical axis of the cross axes 10 in the universal joint 7. The pivot 18 and the top end of the rocker arm 15 are interconnected by a connecting rod 19 having ball joints on its ends.

With the arrangement described above, the pair of angling jacks 13 can maintain a vertical posture of the blade 2 and be extended and contracted in opposition to each other to provide for adjustment of blade angle, as shown by imaginary lines in FIG. 2. The tilting jack 17 can stabilize the blade 2 with respect to a horizontal plane against rotation of the blade 2 about the rotatable shaft 9 of the universal joint 7. The tilting jack 17 is extended or contracted to actuate the rocker arm 15 which in turn pushes or pulls the connecting rod 19 to adjust blade tilt as shown by imaginery lines in FIG. 3.

When the blade 2 is tilted, the pair of angling jacks 13 move arcuately in opposite, vertical directions to deflect the blade 2 backward. However, the connecting rod 19 with its joints is horizontally displaced by the deflecting blade 2, without causing any resistance to the rearward deflecting motion of the blade 2.

What I claim is:

1. A mounting apparatus for supporting a bulldozer blade on a vehicle said apparatus comprising (a) a mounting frame having side members with one end pivotally connected to said vehicle and extending therefrom and an intermediate member connectible between the other ends of said side members;

(b) a universal joint for connecting a central portion of said blade to said intermediate member;

(c) a pair of hydraulic jacks for angling said blade, each said jack having one end pivotally connected to said mounting frame and the other end connectible to a side of said blade;

(d) means for operating said pair of hydraulic jacks in opposition to each other for adjusting the angle of said blade;

(e) a rocker arm pivotally mounted to said intermediate portion wherein said intermediate member includes a bracket, said bracket being pivotally connected to said rocker arm at a location centrally between one end and the other end of said rocker arm;

(f) a tilting jack connected and extending therebetween to said mounting frame and the one end of said rocker arm; and (g) a connecting rod connected to the other end of said rocker arm and connectible to said blade and extending therebetween when connected, wherein said tilting jack tilts said rocker arm and thereby tilts said blade when connected about the longitudinal axis of said universal joint.

2. The mounting apparatus according to claim 1 wherein said universal joint comprises a rotary axis having a holder and cross axes secured to the holder, said rotary axis being connected to the intermediate member of the mounting frame and a perpendicular axis of said cross axes being connected to the blade.

* * * * *